US006227420B1

(12) United States Patent
Jepson

(10) Patent No.: US 6,227,420 B1
(45) Date of Patent: May 8, 2001

(54) PASSIVE DRAWBACK VALVE FOR CONDIMENT DISPENSING

(75) Inventor: Antonio J. Jepson, Dixon, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 09/417,279

(22) Filed: Oct. 13, 1999

(51) Int. Cl.[7] ..... B65B 3/00
(52) U.S. Cl. ..... 222/571; 222/1; 222/108
(58) Field of Search ..... 222/1, 108, 571; 141/116, 117, 119, 120

(56) References Cited

U.S. PATENT DOCUMENTS

| | | | | |
|---|---|---|---|---|
| 3,895,748 | * | 7/1975 | Klingenberg | 222/571 |
| 3,913,797 | * | 10/1975 | Brym | 222/571 |
| 4,254,806 | * | 3/1981 | Elsworth | 141/116 |
| 4,394,945 | * | 7/1983 | Taylor, Jr. | 222/571 |
| 4,854,354 | * | 8/1989 | Moeller | 141/116 |
| 4,957,226 | * | 9/1990 | Pacia | 222/108 |
| 5,067,531 | * | 11/1991 | Herzog | 141/116 |
| 5,906,296 | | 5/1999 | Martindale et al. | 222/108 |
| 5,938,119 | * | 8/1999 | Yamada et al. | 222/571 |

* cited by examiner

*Primary Examiner*—J. Casimer Jacyna
(74) *Attorney, Agent, or Firm*—Townsend and Townsend and Crew LLP

(57) ABSTRACT

A condiment drawback valve for a condiment dispensing system compensates for run-on from a depressurized pump during deactivation and draws back any hanging condiment left in the dispensing outlet of the system, thereby eliminating drips after the pump is stopped. The condiment drawback valve includes a continuous-flowing condiment channel fluidicly coupled between the pump and the dispensing outlet. A drawback chamber is in continuous fluid communication with the condiment channel. A spring is disposed in the drawback chamber. A piston is coupled with the spring and is movable to change the volume of the drawback chamber. When a flow gas is supplied to the pump to activate the pump during condiment dispensing, a portion of the gas is directed to the piston to push the piston against the biasing force of the spring and reduce the volume of the drawback chamber. When the flow of gas is terminated to deactivate the pump, the spring returns the piston to the rest position, increasing the volume of the drawback chamber and generating a suction to draw the condiment into the drawback chamber.

20 Claims, 3 Drawing Sheets

PASSIVE DRAWBACK VALVE FOR CONDIMENT DISPENSING

BACKGROUND OF THE INVENTION

This invention relates generally to dispensing systems, and more particularly to a passive drawback valve for condiment dispensing.

At present, condiment packers are unable to remove all air from the condiment during manufacturing or packing. Additionally, small $CO_2$ gas or atmosphere air leaks can cause the pump for the condiment to suck air in the system, literally blending this air with the condiment. The air or gas can cause the condiment to splatter at the nozzle when it exits under pressure and to drip and build up on the nozzle if not properly handled.

Typically, this air is trapped within the condiment between the condiment pump outlet and the dispensing head on/off valve. When the condiment button is deactivated, the mechanical valve seals off the condiment conduit at the delivery nozzle, which in turn stops the condiment flow and thereby stops the pump. At the time of deactivation, pressure is trapped between the pump outlet and the valve at the delivery nozzle. When the condiment button in the delivery nozzle is depressed again, and if an air pocket is within a few feet of the nozzle, the air bubble exits the delivery nozzle with sufficient velocity to cause "spitting" (splattering, spraying) within the immediate area. This can soil a customer's clothes and is a problem for the equipment user.

SUMMARY OF THE INVENTION

The present invention relates to a system for dispensing condiments or the like. It is especially suitable for dispensing condiments that contain solids or semi-solids or particles such as in thousand island dressing and various "secret sauces" favored by restaurants without fouling the dispensing system. The invention provides for dispensing condiment rapidly and efficiently, and uses a passive drawback valve in the condiment dispensing conduit to prevent buildup of the condiment on the dispensing nozzle. The invention is particularly useful in handling condiments that contain residual air or other gases without causing the condiment to splatter when delivered.

In accordance with an aspect of the present invention, a condiment drawback valve includes a condiment inlet, a condiment outlet, and a condiment channel between the condiment inlet and the condiment outlet. A drawback chamber is coupled with the condiment channel. A spring is disposed in the drawback chamber. A piston is coupled with the spring and is movable to change the volume of the drawback chamber. A gas chamber is separated from the drawback chamber by the piston. A source of gas is fluidicly coupled with the gas chamber.

In some embodiments, the condiment channel is free-flowing. The drawback chamber is in continuous fluid communication with the condiment channel. The piston includes a seal providing sealing separation between the drawback chamber and the gas chamber. A controller is coupled with the source of gas for controlling the flow of gas to the gas chamber. In a specific embodiment, the controller is configured to supply a flow of gas to the gas chamber generally simultaneously with condiment flow through the condiment channel and to terminate the flow of gas to the gas chamber generally simultaneously with termination of condiment flow through the condiment channel.

In accordance with another aspect of the invention, a condiment drawback valve includes a condiment inlet, a condiment outlet, and a continuous-flowing condiment channel between the condiment inlet and the condiment outlet. A drawback chamber is fluidicly coupled with the condiment channel. A mechanism is coupled with the drawback chamber for decreasing the volume of the drawback chamber during condiment flow through the condiment channel and increasing the volume of the drawback chamber during termination of condiment flow through the condiment channel.

In accordance with another aspect of the present invention, a condiment drawback valve includes a condiment inlet, a condiment outlet, and a condiment channel between the condiment inlet and the condiment outlet. A drawback chamber is coupled with the condiment channel. A movable member is movable to change the volume of the drawback chamber. A resilient member is coupled with the movable member, and resiliently biases the movable member with a biasing force to a rest position providing a maximum volume of the drawback chamber. A mechanism is coupled with the movable member for applying a variable pressure on the movable member against the biasing force of the resilient member.

In specific embodiments, the mechanism includes a gas chamber separated from the drawback chamber by the movable member and a source of gas fluidicly coupled with the gas chamber. The mechanism further includes a controller for controlling the flow of gas from the source of gas to the gas chamber to apply variable pressure on the movable member against the biasing force of the resilient member.

Another aspect of this invention is a method of dispensing condiment at a dispensing outlet from a condiment source using a gas-driven pump and drawing back the condiment from the dispensing outlet during termination of condiment dispensing. The method includes providing a drawback valve including a continuous-flowing condiment channel fluidicly coupled between the pump and the dispensing outlet. The drawback valve has a drawback chamber fluidicly coupled with the condiment channel. A flow of gas is supplied to compress and reduce the volume of the drawback chamber substantially simultaneously with activation of the pump by a flow of gas to pump the condiment from the condiment source through the condiment channel to the dispensing outlet. The flow of gas is terminated to increase the volume of the drawback chamber substantially simultaneously with deactivation of the pump by stopping the flow of gas to terminate condiment flow from the condiment source through the condiment channel to the dispensing outlet.

In specific embodiments, the drawback valve includes a movable member separating the drawback chamber from a gas chamber and is resiliently biased to a rest position. A flow of gas is supplied to the gas chamber to move the movable member from the rest position to reduce the volume of the drawback chamber. The flow of gas to compress and reduce the volume of the drawback chamber is supplied from a gas flow line which supplies gas to activate the pump.

DESCRIPTION OF THE SPECIFIC EMBODIMENTS

Figure 1:
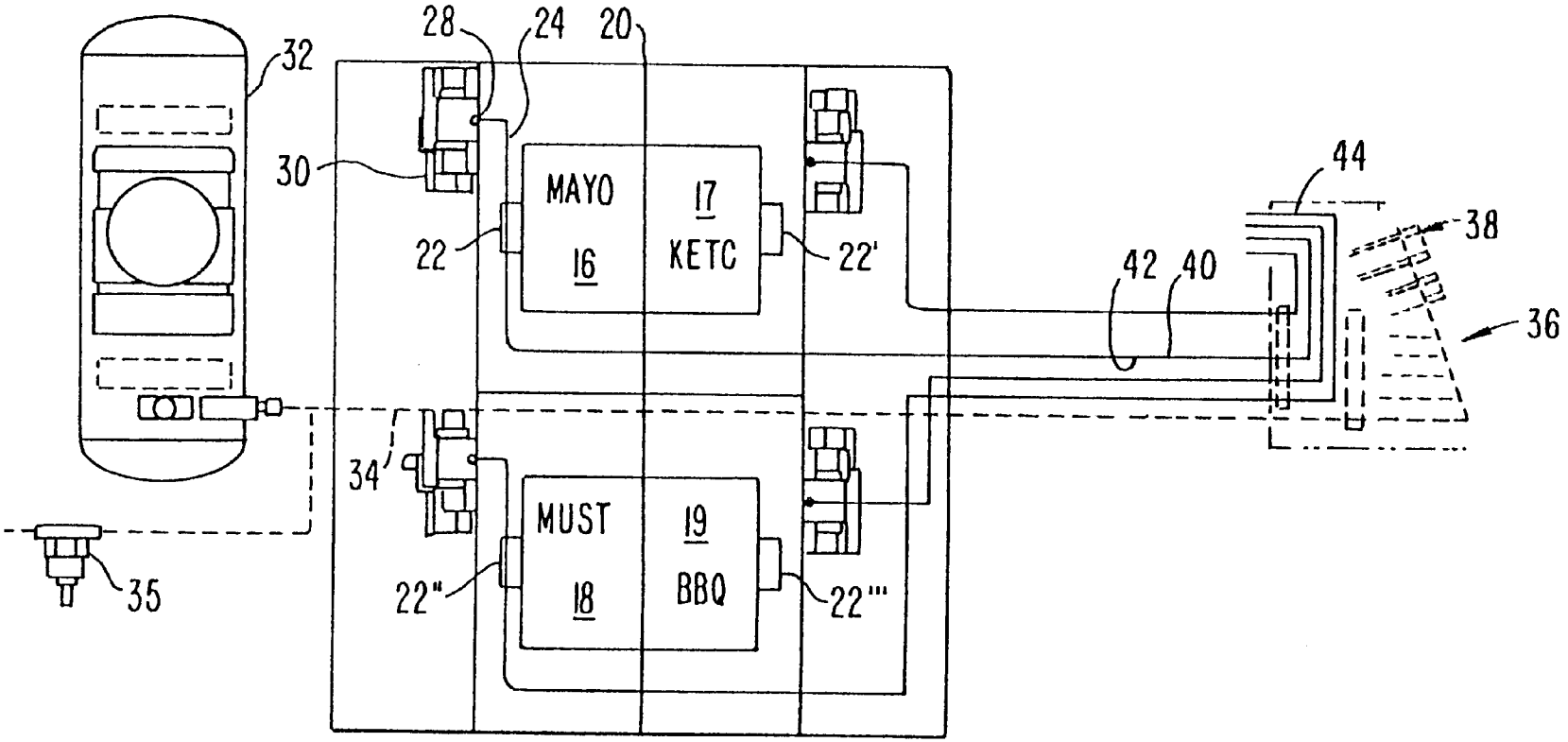
FIG. 1 is a schematic diagram illustrating one system for dispensing condiment in accordance with an embodiment of the present invention.

FIG. 1 shows a system for dispensing condiment or the like. The condiment dispensing system provides for handling condiments in a manner to prevent or minimize fouling of the system and splatter, particularly at the delivery nozzle. This is true, particularly when the condiment contains solid or semi-solid particles or air or other gases such as is found in thousand island dressing or various sauces found in many restaurants.

As noted, condiment packers are unable to remove all air from the condiment during manufacturing or packing. Additionally, small $CO_2$ gas or atmosphere air leaks can cause the pump to suck air into the system, literally blending this air with the product. This air can cause condiment to splatter at the nozzle when it exits under pressure. U.S. Pat. No. 5,906,296 discloses the system of FIG. 1 having a valveless design that switches gas on or off to the pump (rather than stopping flow of condiment in the condiment conduit) as a means of controlling the pump to alleviate this problem. An in-line on/off valve on the condiment conduit not being necessary, condiment is at zero pressure upon deactivation of the pump. Therefore, when the condiment button at the delivery nozzle is once again depressed to start the pump, there is no pressure in the condiment conduit to cause the air to exit the delivery nozzle at a sudden rapid velocity. Therefore, spitting, splattering, and the subsequent mess associated with the resultant condiment spray minimized or eliminated. The entire disclosure of U.S. Pat. No. 5,906,296 is incorporated herein by reference.

As shown in FIG. 1, a rack 20 for holding a source of condiment includes four condiment bags 16–19 which are commercially available. The bags 16–19 may contain, for example, mayonnaise, ketchup, mustard, and barbecue sauce. The bags 16–19 are made to be hung on the rack 20 or to be otherwise supported at a desired location and the condiment withdrawn for use. The rack 20 may be in a form suitable for hanging the condiment bags, or may be formed in the shape of a cradle for supporting the bags. The bags are each formed with a condiment outlet 22, 22', 22", 22'''. For simplicity, the following discussion is directed to the condiment bag 16 having the condiment outlet 22. The outlet 22 is connected to a conduit 24, which provides a flow path from the condiment bag 16 to the suction or inlet side 28 of a condiment pump 30.

The condiment pump 30 is desirably a dual diaphragm type pump. There are commercially available pumps that can be used. One such pump, for example, is Model No. "Smooth" 166-200-11 by Shurflow of Santa Ana, Calif. It will be appreciated that any suitable pump may be used. The pump is preferably gas driven. A source of gas 32 having $CO_2$ or air, for example, is operatively connected by a gas conduit 34 to the operating handle or tower 36 through a valve 38 and then to the pump 30 by a gas conduit 40. A pressure regulator 35 may be used to control pressure in the gas conduit 34. The valve 38 is normally closed to block gas flow to the pump 30. When the valve 38 is opened, the pump 30 will be activated by gas flowing through the gas conduits 34, 40.

A condiment conduit 42 is directly connected between the outlet of the pump 30 and the operating handle or tower 36. There are no valves on the condiment conduit 42 or in the condiment flow channel of the operating handle or tower 36 in this embodiment. Thus, the condiment delivery conduit is continuous, free-flowing. When the valve 38 in the operating handle or tower 36 is opened to permit gas flow to the pump 30, the pump 30 moves condiment to the operating handle or tower 36 for dispensing out of the nozzle 44.

Figure 2:
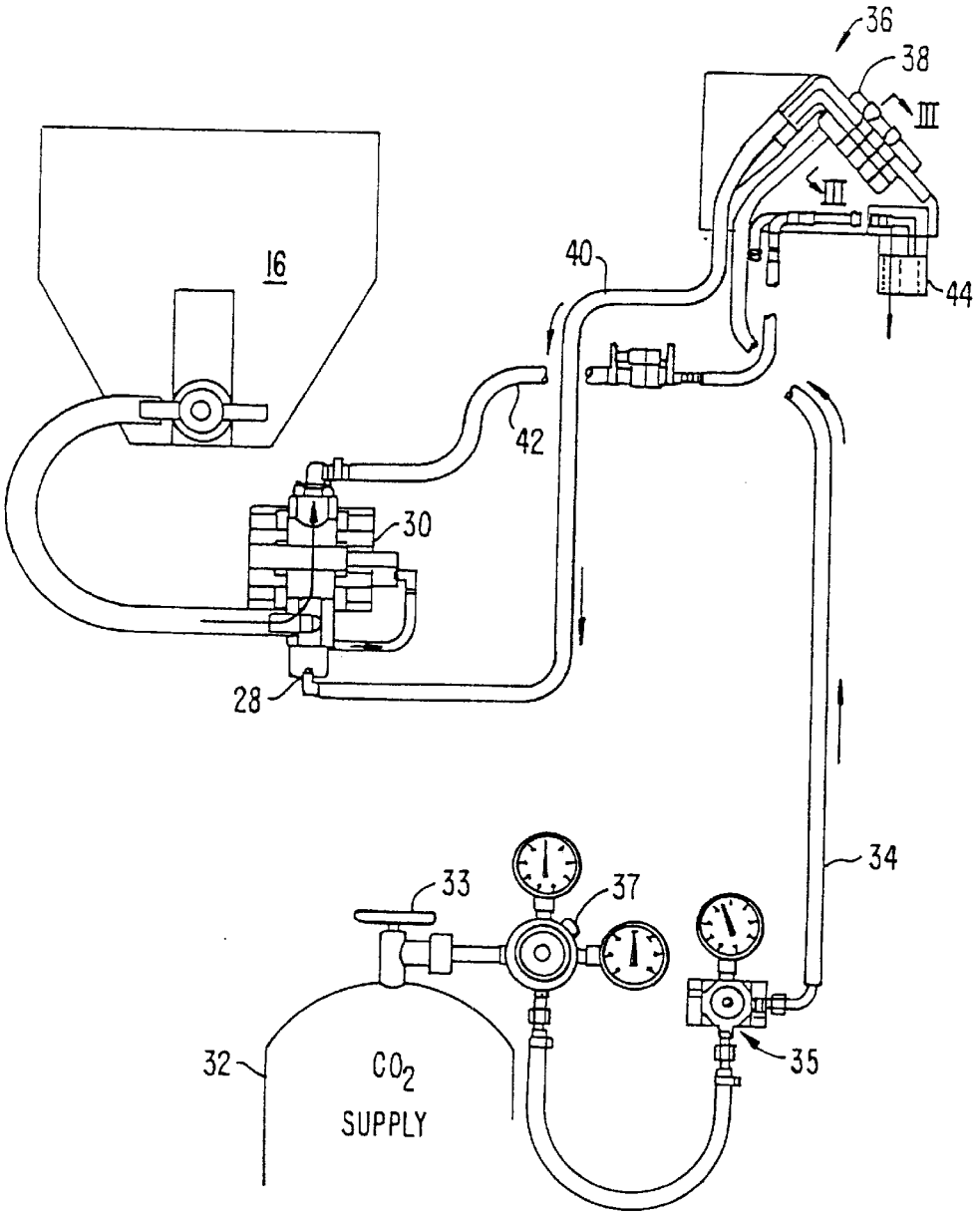
FIG. 2 is an enlarged schematic diagram illustrating portions of the system of FIG. 1 in more detail.
Figure 3:
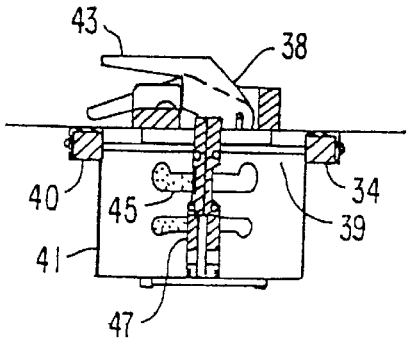
FIG. 3 is a sectional view taken along line III—III of FIG. 2.

In the enlarged schematic diagram of FIG. 2, a source of gas 32 is connected through a valve 33, a meter 37, and a pressure regulator 35 by means of the conduit 34 to the operating handle or tower 36. The conduit 34 is connected to the valve 38, which is normally closed to prevent gas flow therethrough. FIG. 3 shows the valve 38 in more detail. The conduit 40 is connected downstream of the valve 38 and extends to the pump 30 where it is operatively connected to the suction side 28 of the pump 30. The condiment conduit 42 is connected between the outlet of the pump 30 and the delivery nozzle 44 in the operating handle or tower 36. When the valve 38 is opened, the pump 30 is activated by the gas flowing through the gas conduits 34, 40. The pump 30 draws condiment from the bag in the box source 16 which flows through the condiment conduit through the flow control 41 and then out of the nozzle 44. Flow control 41 is a control with an adjustable orifice for use in controlling flow of condiments of different viscosities. There are no operating valves on the conduit 42 in this embodiment.

The valve 38 is connected at the delivery nozzle 44 on the tower 36 for controlling the flow of gas from the gas source 32 through the conduit 34, and then through the opening 39 in the valve body 41 when the valve lever 43 is depressed as shown in phantom in FIG. 3 to depress the valve stem 45 to align the openings. A spring 47 is used to return the valve 38 to a closed position when the pressure on the lever 43 is released. The embodiment shows a tower 36 to support the delivery nozzle 44. It is understood that the delivery nozzle 44 may be utilized in a handheld dispenser instead.

Figure 4:
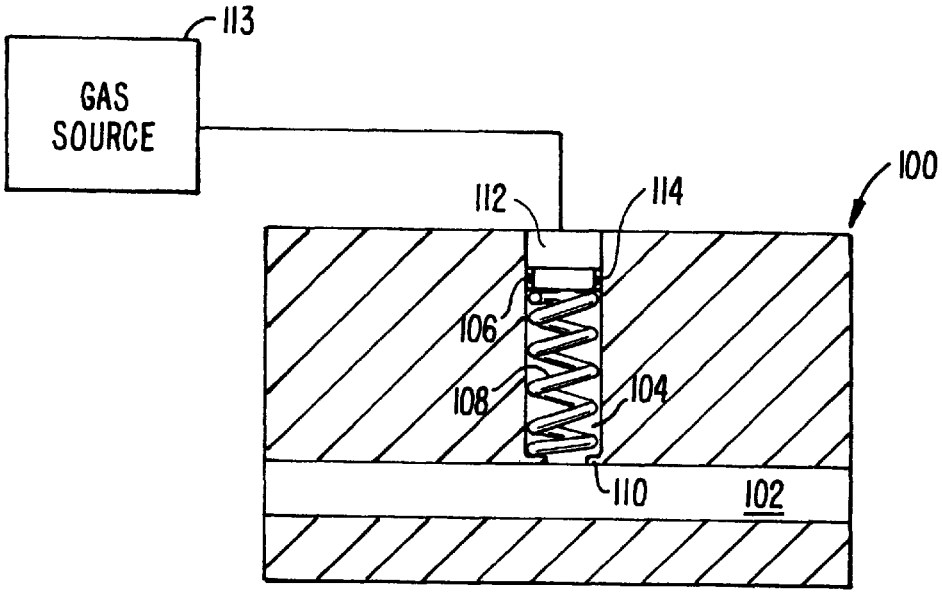
FIG. 4 is a simplified schematic view of a passive drawback valve in accordance with an embodiment of the present invention.
Figure 5:
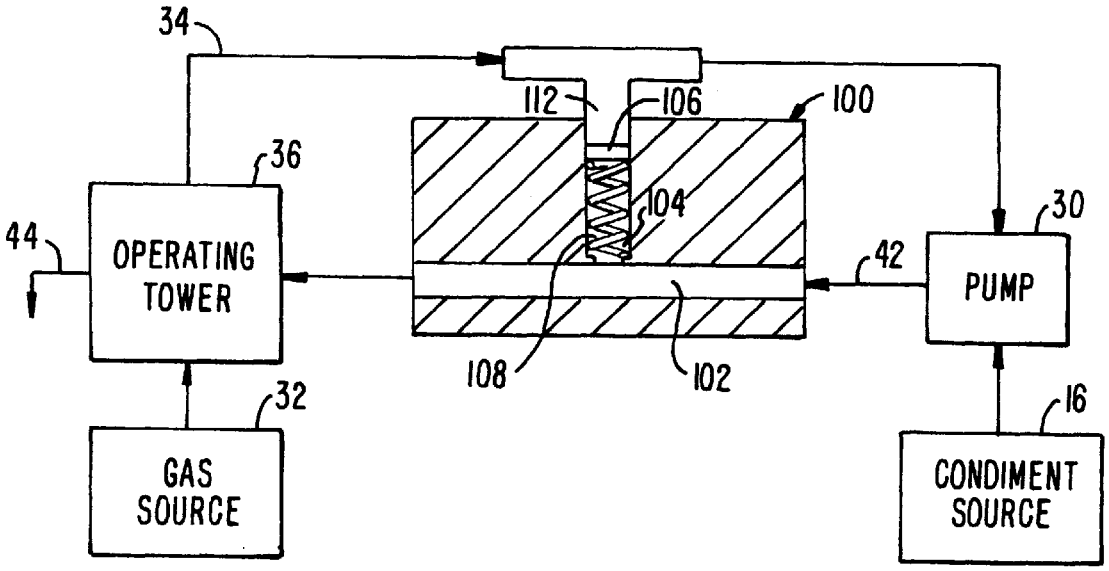
FIG. 5 is a schematic diagram of the system of FIG. 2 including the passive drawback valve of FIG. 4.

FIG. 4 shows a passive drawback valve 100. The drawback valve 100 has a condiment channel 102 with an inlet and an outlet. Connected with the condiment channel 102 is a drawback chamber 104. A piston 106 is disposed in the drawback chamber 104 and movable therein to vary the volume of the drawback chamber 104. The piston 106 is connected with an end of a spring 108 disposed in the drawback chamber 104. The other end of the spring 108 is fixed at a spring seat 110. On the other side of the piston 106 is a gas chamber 112 which is fluidicly connected with a gas source 113. The piston 106 is preferably sealed, for instance, by an O-ring 114 to isolate the gas chamber 112 from the drawback chamber 104.

In a preferred embodiment of the invention, the passive drawback valve 100 is provided in the system of FIGS. 1–3. The passive drawback valve 100 is disposed in the condiment dispensing conduit 42 between the pump 30 and the delivery nozzle 44 of the tower 36. The condiment channel 102 is connected with the condiment conduit 42 for continuous, free-flowing of the condiment therethrough when the pump 30 is activated. The gas chamber 112 is fluidicly connected with the gas conduit 34.

In use, when the condiment button at the delivery nozzle 44 is depressed to flow the gas through the gas conduit 34 to start the pump 30, the gas pressure in the gas chamber 112 of the passive drawback valve 100 pushes the piston 106 toward the condiment channel 102, compressing the spring 108. The piston 106 pushes any condiment in the drawback chamber 104 into the condiment channel 102 to be dispensed through the delivery nozzle 44. The volume of the gas chamber 112 increases, while the volume of the drawback chamber 104 decreases.

When the condiment button at the delivery nozzle 44 is released, the gas flow through the gas conduit 34 is terminated and the gas pressure in the gas chamber 112 behind the piston 106 drops. The spring 108 returns to its rest position, pushing the piston 106 away from the conduit channel 102 to decrease the volume of the gas chamber 112 and increase the volume of the drawback chamber 104. The movement of the piston 106 generates a vacuum or suction to draw the condiment into the drawback chamber 104. This drawback action compensates for run-on from the depressurized pump 30 and draws back any hanging condiment left in the delivery nozzle 44, thereby eliminating or minimizing drips after the pump 30 is stopped.

The above-described arrangements of apparatus and methods are merely illustrative of applications of the principles of this invention and many other embodiments and modifications may be made without departing from the spirit and scope of the invention as defined in the claims. For instance, the spring may be replaced by a different resilient biasing member. A different mechanism may be used to vary the volume of the drawback chamber. The scope of the invention should, therefore, be determined not with reference to the above description, but instead should be determined with reference to the appended claims along with their full scope of equivalents.

What is claimed is:

1. A condiment drawback valve comprising:

a condiment inlet;

a condiment outlet;

a condiment channel between the condiment inlet and the condiment outlet;

a drawback chamber coupled with the condiment channel;

a spring disposed in the drawback chamber;

a piston coupled with the spring and being movable to change the volume of the drawback chamber;

a gas chamber separated from the drawback chamber by the piston; and a source of gas fluidicly coupled with the gas chamber.

2. The condiment drawback valve of claim 1 wherein the condiment channel is free-flowing.

3. The condiment drawback valve of claim 1 wherein the drawback chamber is in continuous fluid communication with the condiment channel.

4. The condiment drawback valve of claim 1 wherein the piston includes a seal providing sealing separation between the drawback chamber and the gas chamber.

5. The condiment drawback valve of claim 1 wherein the piston is slidable generally linearly in the drawback chamber.

6. The condiment drawback valve of claim 1 wherein the spring has an end coupled with the piston and another end anchored in a spring seat disposed between the piston and the condiment channel.

7. The condiment drawback valve of claim 1 further comprising a controller coupled with the source of gas for controlling the flow of gas to the gas chamber.

8. The condiment drawback valve of claim 7 wherein the controller is configured to supply a flow of gas to the gas chamber generally simultaneously with condiment flow through the condiment channel and to terminate the flow of gas to the gas chamber generally simultaneously with termination of condiment flow through the condiment channel.

9. The condiment drawback valve of claim 7 wherein the controller is configured to pressurize the gas chamber with the flow of gas to decrease the volume of the drawback chamber during condiment flow through the condiment channel and to depressurize the gas chamber to increase the volume of the drawback chamber during termination of condiment flow through the condiment channel.

10. A condiment drawback valve comprising:

a condiment inlet;

a condiment outlet;

a condiment channel between the condiment inlet and the condiment outlet;

a drawback chamber coupled with the condiment channel;

a movable member movable to change the he drawback chamber;

a resilient member disposed in the drawback chamber and being coupled with the movable member, the resilient member resiliently biasing the movable member with a biasing force to a rest position providing a maximum volume of the drawback chamber; and a gas chamber separated from the drawback chamber by the movable member for applying a variable pressure on the movable member against the biasing force of the resilient member.

11. The condiment drawback valve of claim 10 wherein the condiment channel is continuous-flowing.

12. The condiment drawback valve of claim 10 wherein the drawback chamber is in continuous fluid communication with the condiment channel.

13. The condiment drawback valve of claim 10 wherein the resilient member comprises a spring having an end coupled with the movable member and another end anchored in a spring seat disposed between the movable member and the condiment channel.

14. The condiment drawback valve of claim 10 further comprising a source of gas fluidicly coupled with the gas chamber.

15. The condiment drawback valve of claim 10 further comprising a controller for controlling a flow of gas to the gas chamber to apply variable pressure on the movable member against the biasing force of the resilient member.

16. The condiment drawback valve of claim 15 wherein the controller is configured to supply a flow of gas to the gas chamber generally simultaneously with condiment flow through the condiment channel and to terminate the flow of gas to the gas chamber generally simultaneously with termination of condiment flow through the condiment channel.

17. The condiment drawback valve of claim 15 wherein the controller is configured to pressurize the gas chamber with the flow of gas to decrease the volume of the drawback chamber during condiment flow through the condiment channel and to depressurize the gas chamber to increase the volume of the drawback chamber during termination of condiment flow through the condiment channel.

18. A method of dispensing condiment at a dispensing outlet from a condiment source using a gas-driven pump and drawing back the condiment from the dispensing outlet during termination of condiment dispensing, the method comprising:

providing a drawback valve including a condiment channel fluidicly coupled between the pump and the dispensing outlet, the drawback valve having a drawback chamber fluidicly coupled with the condiment channel;

supplying a flow of gas to compress and reduce the volume of the drawback chamber substantially simultaneously with activation of the pump by a flow of gas to pump the condiment from the condiment source through the condiment channel to the dispensing outlet; and terminating the flow of gas to increase the volume of the drawback chamber substantially simultaneously with deactivation of the pump by stopping the flow of gas to terminate condiment flow from the condiment source through the condiment channel to the dispensing outlets, wherein the drawback valve includes a movable member separating the drawback chamber from a gas chamber and being resiliently biased by a spring disposed in the drawback chamber to a rest position, wherein supplying a flow of gas comprises supplying the flow of gas to the gas chamber to move the movable member from the rest position to reduce the volume of the drawback chamber.

19. The method of claim 18 wherein the condiment channel is free-flowing.

20. The method of claim 18 wherein the flow of gas to compress and reduce the volume of the drawback chamber is supplied from a gas flow line which supplies gas to activate the pump.

* * * * *